US009457362B2

(12) United States Patent
Chan

(10) Patent No.: US 9,457,362 B2
(45) Date of Patent: Oct. 4, 2016

(54) OVERHEAD SHOWERHEAD ENABLING AUTO-CLEANING OF NOZZLE OPENINGS THEREOF

(71) Applicant: Jason Siu ming Chan, Kowloon Bay (HK)

(72) Inventor: Jason Siu ming Chan, Kowloon Bay (HK)

(73) Assignee: AQUAmate Sanitary Ware Europe Ltd, Kowloon (HK)

( * ) Notice: Subject to any disclaimer, the term of this patent is extended or adjusted under 35 U.S.C. 154(b) by 0 days.

(21) Appl. No.: 14/819,431

(22) Filed: Aug. 6, 2015

(65) Prior Publication Data

US 2016/0121344 A1 May 5, 2016

(30) Foreign Application Priority Data

Nov. 4, 2014 (CN) ..... 2014 2 0650822 U

(51) Int. Cl.
*B05B 15/02* (2006.01)
*B05B 1/18* (2006.01)

(52) U.S. Cl.
CPC ..... *B05B 1/185* (2013.01); *B05B 15/0216* (2013.01); *B05B 15/0233* (2013.01)

(58) Field of Classification Search
CPC ..... B05B 1/18; B05B 1/185; B05B 3/00; B05B 3/02; B05B 3/04; B05B 3/06; B05B 3/008; B05B 3/0463; B05B 3/0486; B05B 15/02; B05B 15/0208; B05B 15/0216; B05B 15/0225; B05B 15/0233
USPC ..... 239/114–118, 123, 106, 380–383; 4/567, 615
See application file for complete search history.

(56) References Cited

U.S. PATENT DOCUMENTS

| | | | | |
|---|---|---|---|---|
| 1,236,617 | A * | 8/1917 | Speakman | B05B 15/0233 137/244 |
| 2,251,192 | A * | 7/1941 | Krumsiek | B05B 1/3046 239/117 |
| 5,718,380 | A * | 2/1998 | Schorn | B05B 15/0233 239/117 |
| 2012/0048968 | A1* | 3/2012 | Williams | E03C 1/0409 239/443 |
| 2015/0196927 | A1* | 7/2015 | Ramos De Barros | B05B 1/3006 239/107 |

* cited by examiner

*Primary Examiner* — Arthur O Hall
*Assistant Examiner* — Tuongminh Pham

(57) ABSTRACT

An overhead showerhead enabling auto-cleaning of nozzle openings thereof; the overhead showerhead has a showerhead shell and a water ejection surface front cover removably connected with each other; a plurality of nozzles are provided on the water ejection surface front cover; a first cavity is provided inside the showerhead shell; a water ejection device, a cleaning disc and a driving device for driving the cleaning disc to move up and down are provided inside the first cavity; the cleaning disc is provided with a plurality of cleaning rods; positioning of the cleaning rods corresponds to positioning of the nozzles.

4 Claims, 2 Drawing Sheets

OVERHEAD SHOWERHEAD ENABLING AUTO-CLEANING OF NOZZLE OPENINGS THEREOF

BACKGROUND OF THE INVENTION

The present invention relates to a kind of shower equipment, and more specifically relates to an overhead showerhead enabling auto-cleaning of nozzle openings thereof.

An overhead showerhead is a kind of shower equipment positioned above a user's head for showering. An overhead showerhead now available in the market comprises a water pipe having a connection port, a rear cover connected to the water pipe and a showerhead body. A sealed cavity is formed between the showerhead body and the rear cover. The showerhead body is provided with a plurality of nozzles for ejection of water. Water flows continuously into the sealed cavity and then ejects out of the nozzles.

Tap water contains sediments which may be agglomerated at the nozzles. These sediments cannot be easily removed and they may block the nozzles as time goes by. Therefore, it is necessary to dismount the overhead showerhead for cleaning and thus causing much inconvenience to users.

BRIEF SUMMARY OF THE INVENTION

In view of the aforesaid disadvantages now present in the prior art, the present invention provides an overhead showerhead which enables auto-cleaning of its nozzle openings. Therefore, the present invention can clean the nozzles of the overhead showerhead automatically. Accordingly, the present invention is more convenient to use since it is not necessary to dismount the overhead showerhead for cleaning.

To attain the above object, the present invention provides an overhead showerhead enabling auto-cleaning of nozzle openings thereof; the overhead showerhead comprises a showerhead shell and a water ejection surface front cover; the showerhead shell and the water ejection surface front cover are removably connected; a plurality of nozzles are provided on the water ejection surface front cover; a first cavity is provided inside the showerhead shell; a water ejection device, a cleaning disc and a driving device for driving the cleaning disc to move up and down are provided inside the first cavity; the cleaning disc is provided with a plurality of cleaning rods; positioning of the cleaning rods corresponds to positioning of the nozzles.

Preferably, the driving device comprises a rotor assembly; two sides of the rotor assembly are provided with two eccentric wheels, one at each side; the cleaning disc is provided with lateral rods; the eccentric wheels and the lateral rods are connected by link rods for transmission of motion; one end of each of the link rods sleeves on a respective eccentric wheel of the eccentric wheels, another end of each of the link rods sleeves on a respective lateral rod of the lateral rods.

Preferably, the water ejection device comprises a spherical head and a seat; the spherical head comprises a spherical water outlet front portion and a water inlet end portion; the water outlet front portion of the spherical head is inserted into the seat; a seal ring is provided inside the seat.

Preferably, the water outlet front portion of the spherical head is sleeved with a fixation ring.

Preferably, a screw nut locking part for fixing the water ejection device is provided at a bottom part of the seat; the screw nut locking part is provided with outer screw threads; an inner portion of the showerhead shell is provided with inner screw threads; the screw nut locking part and the showerhead shell are connected via the outer screw threads and inner screw threads provided respectively on the screw nut locking part and the inner portion of the showerhead shell; a pressing block for mounting the rotor assembly is provided inside the screw nut locking part.

The present invention has the following beneficial effects: The present invention is an overhead showerhead enabling auto-cleaning of nozzle openings thereof; the overhead showerhead comprises a showerhead shell and a water ejection surface front cover; the showerhead shell and the water ejection surface front cover are removably connected; a plurality of nozzles are provided on the water ejection surface front cover; a first cavity is provided inside the showerhead shell; a water ejection device, a cleaning disc and a driving device for driving the cleaning disc to move up and down are provided inside the first cavity; water enters the water ejection device through a pipe and is then being ejected by the water ejection device; water ejected by the water ejection device has a power of thrust to drive the rotary assembly to rotate; since the two sides of the rotary assembly are provided with eccentric wheels, rotation of the rotary assembly will drive the eccentric wheels to rotate as well; due to motion transmission where motion is transmitted from the eccentric wheels via the link rods to the lateral rods, rotation of the rotor assembly drives the cleaning disc to move up and down and therefore allow the cleaning rods to remove unwanted substances clogging the nozzles by removing the unwanted substances out through the nozzles. The present invention is convenient to use since it can clean the nozzles of the overhead showerhead automatically without the need of dismounting the overhead showerhead for cleaning.

REFERENCE SIGNS

1: showerhead shell; 2: water ejection surface front cover; 21: nozzles; 3: cleaning disc; 31: cleaning rod; 32: lateral rods; 41: rotor assembly; 42: eccentric wheels; 5: link rods; 61: spherical head; 611: water outlet front portion; 612: water inlet end portion; 62: seat; 63: fixation ring; 7: seal ring; 8: screw nut locking part; 81: pressing block.

DETAILED DESCRIPTION OF THE INVENTION

Figure 1:
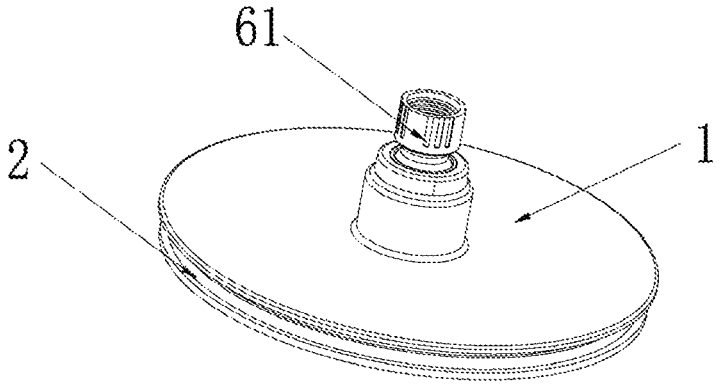
FIG. 1 is a perspective view showing the structure of the present invention.
Figure 2:
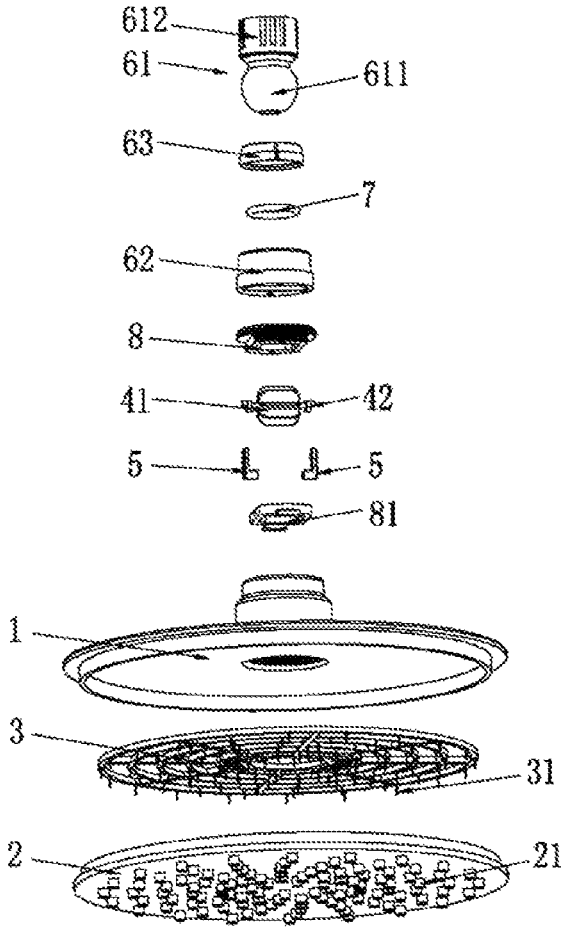
FIG. 2 is a perspective exploded view showing the structure of the present invention.
Figure 3:
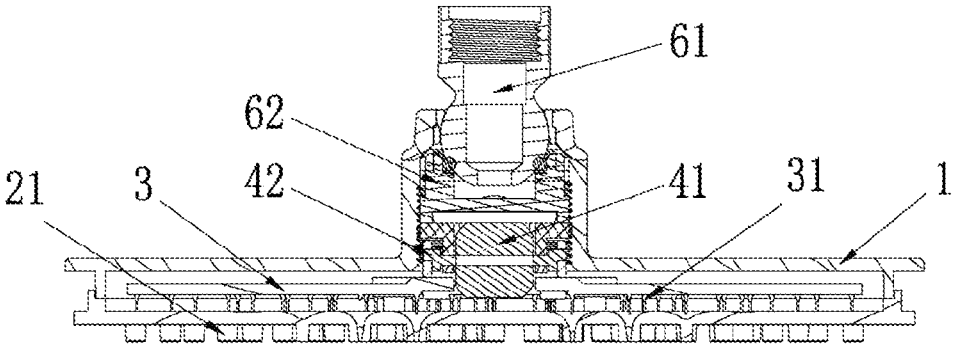
FIG. 3 is a sectional view showing the structure of the present invention.
Figure 4:
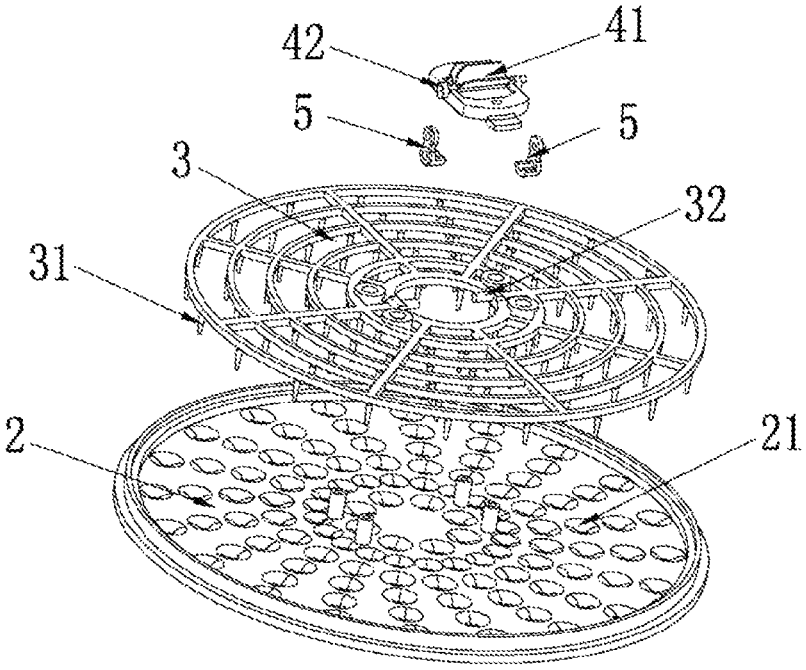
FIG. 4 is an exploded structural view of the rotor assembly, cleaning disc and the water ejection surface front cover.

The present invention is described further in detail below with reference to an embodiment and FIGS. 1-4.

As shown in FIGS. 1-4, an overhead showerhead enabling auto-cleaning of nozzle openings thereof comprises a showerhead shell 1 and a water ejection surface front cover 2. The showerhead shell 1 and the water ejection surface front cover 2 are removably connected. A plurality of nozzles 21 are provided on the water ejection surface front cover 2. A first cavity is provided inside the showerhead shell 1. A water ejection device, a cleaning disc 3 and a driving device for driving the cleaning disc 3 to move up and down are provided inside the first cavity. The cleaning disc 3 is provided with a plurality of cleaning rods 31. Positioning of the cleaning rods 31 corresponds to positioning of the nozzles 21.

In the present embodiment, the water enters the water ejection device through a pipe and is then being ejected by the water ejection device. Water ejected by the water ejection device has a power of thrust so that the driving device can drive the cleaning disc 3 to move up and down and therefore allow the cleaning rods 31 to remove unwanted substances clogging the nozzles by removing the unwanted substances out through the nozzles. The present invention is convenient to use since it can clean the nozzles of the overhead showerhead automatically without the need of dismounting the overhead showerhead for cleaning.

An embodiment of the driving device is detailed as follows: the driving device comprises a rotor assembly 41. Two sides of the rotor assembly 41 are provided with two eccentric wheels 42, one at each side. The cleaning disc 3 is provided with lateral rods 32. The eccentric wheels 42 and the lateral rods 32 are connected by link rods 5 for transmission of motion. One end of each of the link rods 5 sleeves on a respective eccentric wheel of the eccentric wheels 42, another end of each of the link rods 5 sleeves on a respective lateral rod of the lateral rods 32. Since the water ejected by the water ejection device has a power of thrust which can drive the rotor assembly 41 to rotate while the eccentric wheels 42 are provided at the two sides of the rotor assembly 41, rotation of the rotor assembly 41 will drive the eccentric wheels 42 to rotate as well. Due to motion transmission where motion is transmitted from the eccentric wheels 42, via the link rods 5, and to the lateral rods 32, rotation of the rotor assembly 41 will drive the cleaning disc 3 to move up and down so that the cleaning rods 31 can remove the unwanted substances clogging the nozzles by removing the unwanted substances out through the nozzles.

An embodiment of the water ejection device is detailed as follows: the water ejection device comprises a spherical head 61 and a seat 62. The spherical head 61 comprises a spherical water outlet front portion 611 and a water inlet end portion 612. The water outlet front portion 611 of the spherical head 61 is inserted into the seat 62. A seal ring 7 is provided inside the seat 62. The water outlet front portion 611 of the spherical head 61 is sleeved with a fixation ring 63. A screw nut locking part 8 for fixing the water ejection device is provided at a bottom part of the seat 62. The screw nut locking part 8 is provided with outer screw threads. An inner portion of the showerhead shell 1 is provided with inner screw threads. The screw nut locking part 8 and the showerhead shell 1 are connected via the outer screw threads and inner screw threads provided respectively on the screw nut locking part 8 and the inner portion of the showerhead shell 1. A pressing block 81 for mounting the rotor assembly 41 is provided inside the screw nut locking part 8.

The working principle of the present invention is detailed as follows: water enters into the spherical head 61 through the water inlet end portion 612 of the spherical head 61; due to the effect of the spherical head 61, water ejected from the water outlet front portion 611 of the spherical head 61 has a power of thrust which drives the rotor assembly 41 to rotate; since the two sides of the rotor assembly 41 are provided with eccentric wheels 42, rotation of the rotor assembly 41 also drives the eccentric wheels 42 to rotate; due to motion transmission where motion is transmitted from the eccentric wheels 42 via the link rods 5 and to the lateral rods 32, rotation of the rotor assembly 41 will eventually drive the cleaning disc 3 to move up and down and therefore allow the cleaning rods 31 to remove the unwanted substances clogging the nozzles 21 by removing the unwanted substances out through the nozzles 21. The present invention is convenient to use since it is not necessary to dismount the overhead showerhead for cleaning.

The above description is only a preferred embodiment of the present invention. The present invention should not be considered limited to the above description. A person skilled in this field of art may make changes to the specific implementation of the present invention and to the scope of application of the present invention based on the inventive idea of the present invention.

What is claimed is:

1. An overhead showerhead enabling auto-cleaning of nozzle openings thereof; the overhead showerhead comprises a showerhead shell (1) and a water ejection surface front cover (2); the showerhead shell (1) and the water ejection surface front cover (2) are removably connected; a plurality of nozzles (21) are provided on the water ejection surface front cover (2); a first cavity is provided inside the showerhead shell (1); wherein a water ejection device, a cleaning disc (3) and a driving device for driving the cleaning disc (3) to move up and down are provided inside the first cavity; the cleaning disc (3) is provided with a plurality of cleaning rods (31); positioning of the cleaning rods (31) corresponds to positioning of the nozzles (21); the driving device corn rises a rotor assembly (41); two sides of the rotor assembly (41) are provided with two eccentric wheels (42), one at each side; the cleaning disc (3) is provided with lateral rods (32); the eccentric wheels (42) and the lateral rods (32) are connected by link rods (5) for transmission of motion; one end of each of the link rods (5) sleeves on a respective eccentric wheel of the eccentric wheels (42), another end of each of the link rods (5) sleeves on a respective lateral rod of the lateral rods (32).

2. The overhead showerhead enabling auto-cleaning of nozzle openings thereof as in claim 1; wherein the water ejection device comprises a spherical head (61) and a seat (62); the spherical head (61) comprises a spherical water outlet front portion (611) and a water inlet end portion (612); the water outlet front portion (611) of the spherical head (61) is inserted into the seat (62); a seal ring (7) is provided inside the seat (62).

3. The overhead showerhead enabling auto-cleaning of nozzle openings thereof as in claim 2; wherein the water outlet front portion (611) of the spherical head (61) is sleeved with a fixation ring (63).

4. The overhead showerhead enabling auto-cleaning of nozzle openings thereof as in claim 2; wherein a screw nut locking part (8) for fixing the water ejection device is provided at a bottom part of the seat (62); the screw nut locking part (8) is provided with outer screw threads; an inner portion of the showerhead shell (1) is provided with inner screw threads; the screw nut locking part (8) and the showerhead shell (1) are connected via the outer screw threads and the inner screw threads provided respectively on the screw nut locking part (8) and the inner portion of the showerhead shell (1); a pressing block (81) for mounting the rotor assembly (41) is provided inside the screw nut locking part (8).

* * * * *